US007278465B1

(12) United States Patent
McGuire et al.

(10) Patent No.: US 7,278,465 B1
(45) Date of Patent: Oct. 9, 2007

(54) INVESTMENT CASTING SLURRY COMPOSITION AND METHOD OF USE

(75) Inventors: Daniel S. McGuire, Oregon, WI (US); Eric E. Hellstrom, Madison, WI (US)

(73) Assignee: Wisys Technology Foundation

( * ) Notice: Subject to any disclaimer, the term of this patent is extended or adjusted under 35 U.S.C. 154(b) by 0 days.

(21) Appl. No.: 11/394,690

(22) Filed: Apr. 1, 2006

Related U.S. Application Data

(60) Provisional application No. 60/668,292, filed on Apr. 5, 2005.

(51) Int. Cl.
*B22C 9/04* (2006.01)

(52) U.S. Cl. ..... 164/519; 164/35

(58) Field of Classification Search ..... 164/516–519, 164/35

See application file for complete search history.

(56) References Cited

U.S. PATENT DOCUMENTS

| | | | | |
|---|---|---|---|---|
| 3,165,799 | A | 1/1965 | Claude | |
| 4,019,559 | A * | 4/1977 | Szabo | 164/518 |
| 4,026,344 | A | 5/1977 | Greskovich | |
| 4,432,798 | A | 2/1984 | Helferich | |
| 4,581,068 | A | 4/1986 | Schramm | |
| 4,689,081 | A * | 8/1987 | Watts | 106/38.4 |
| 5,147,830 | A | 9/1992 | Banerjee | |
| 5,391,606 | A | 2/1995 | Doles | |
| 6,013,125 | A | 1/2000 | Quraishi | |
| 6,375,692 | B1 | 4/2002 | Manwiller | |
| 6,551,396 | B1 | 4/2003 | Pineda | |
| 6,814,131 | B2 | 11/2004 | Vandermeer | |
| 2006/0081350 | A1 * | 4/2006 | Batllo et al. | 164/131 |

FOREIGN PATENT DOCUMENTS

| | | | |
|---|---|---|---|
| SU | 1419788 | * | 8/1988 |

* cited by examiner

*Primary Examiner*—Kuang Lin
(74) *Attorney, Agent, or Firm*—Robert J. Harter

(57) ABSTRACT

An investment casting method involves producing a casting shell by applying a hardenable moist mixture to a sacrificial pattern. To hasten the hardening of the moist mixture to create the shell, a stucco coat is subsequently applied to the mixture. In some cases, the stucco coat comprises a drier mixture of the elements used in the moist mixture. The drier mixture preferably includes a material that alters the alkalinity of the underlying moist mixture. In some cases, the stucco coat also includes an amorphous mineral silicate. Once the shell is created, a molten metal is introduced into the shell to replace the sacrificial pattern, thereby producing a metal cast item.

15 Claims, 4 Drawing Sheets

INVESTMENT CASTING SLURRY COMPOSITION AND METHOD OF USE

CROSS-REFERENCE TO RELATED APPLICATION

This application claims the benefit of provisional patent application Ser. No. 60/668,292 filed on Apr. 5, 2005 by the present inventors.

BACKGROUND OF THE INVENTION

1. Field of the Invention

The present invention is directed to investment casting and more particularly to a composition for an investment casting shell and a corresponding method that minimizes "pattern-to-pour" cycle times at a significant cost savings.

2. Description of Related Art

Investment casting is commonly used to produce high quality metal products with relatively close dimensional tolerances. The investment casting process is well known and commonly practiced. Generally, an investment casting of a part is made by creating a thin-walled ceramic mold over a previously formed pattern of the part. After the mold or shell has hardened, the pattern is melted or otherwise removed from it. The ceramic shell is then filled with a molten metal and allowed to solidify. The shell is then removed to reveal the desired part. Typically, some post-process conditioning is required to finish the part. Notably, the process may also be referred to herein with one or more of the following terms including lost wax, lost pattern, ceramic shell, or precision casting.

More particularly, as noted, investment casting methods initially include constructing a pattern of the original object to be replicated. Because this pattern will later be burned or, melted out of the shell, it must be either a low melting point substrate or a combustible substrate. Such substrates may include, for example, wax, polystyrene, plastic, or synthetic rubber.

It is also notable that traditional investment casting slurries must be continuously blunged to remain viable for use as a shell material. Otherwise, the slurry "settles out" and hardens, thus becoming useless. This is a further drawback in terms of in convenience and cost (blunging machinery, labor, short shelf-life, etc.), and thus an alternate slurry composition that does not require blunging would be ideal.

An additional drawback to traditional methods is that they require the pattern to be dipped into a refractory slurry then coated with dry refractory grains, over and over, until the desired shell thickness is obtained. Typically, shells are gradually built up to a thickness of approximately ⅛ inch or more to attempt to prevent defects from appearing in the final part. Such defects typically result from the shell shrinking, sagging or cracking. It is not uncommon in industry to use seven or more layers per shell. For some applications, the coats are applied with conventional manual dipping, but for many applications, including larger volume industrial applications, such manual dipping is prohibitively impractical. As a result, costly robotic manipulators may be required for dipping, thus serving as another barrier to those users who could otherwise effectively employ investment casting methods.

Overall, the process of shell building is time consuming because each coat of slurry (each with a corresponding coat of refractory grains) must be air-dried prior to the application of subsequent coats. Notably, in this regard, known shells cannot be baked at elevated temperatures for extended periods of time without compromising the integrity of the cured shell. In the end, the process of dipping, air-drying, and redipping requires twenty-four to forty-eight hours or more to complete.

After drying, the shell is heated to at least the melting or burning point of the substrate (i.e., pattern). During this step, the substrate is melted or burned away leaving only the shell and any residual substrate. The shell is then heated to a temperature high enough to flash off the residual substrate which remains in the shell.

Before the shell has cooled significantly, the molten metal will be poured into it. Various methods are used to introduce molten metal into shells including gravity, vacuum pressure, and centrifugal methods. Notably, a shell material that has a low thermal conductivity will require a lower temperature of molten metal than one that does not have a low thermal conductivity. As understood in the art, pouring molten metal at a lower than typical temperature facilitates producing parts with more detail, and yields less oxidation. Therefore, a shell material that retains more heat is typically preferred.

Upon cooling and solidification of the molten metal, the casting shell may then be removed from the casting in conventional fashion such as by hammering or sand blasting. After the shell is removed from the casting, the casting may require a cleaning or finishing step.

More specifically, in addition to physical dimensional defects, if chemicals within a shell react with the molten metal, oxides or scaling typically will be formed and must be removed. In conventional investment casting, bead blasting or other methods of abrasion are often used to remove any oxidation, flashing and/or residual shell material from the part.

Due to economic pressures, an investment casting method that is quicker than known methods, yet accurate, was desired. To decrease the cost of producing investment cast parts, the time between creating the shell and the time that the molten metal is poured into the shell, or the "pattern-to-pour" cycle time, should be minimized. Additionally, the part as cast must be free from defects in order to minimize the need for costly post-casting machining and cleanup. Furthermore, to open the technique up for use by parties with limited budgets, the need for expensive capital equipment associated with current investment casting materials and techniques should preferably be reduced or eliminated.

SUMMARY OF THE INVENTION

In some embodiments, a pattern is coated with a layer of slurry, and to hasten the hardening of the slurry, a stucco coat (i.e., a drier mixture of the slurry's components) is subsequently applied over the moist layer. In some cases, the stucco coat includes a magnesium-containing compound (such as MgO) a calcium-containing compound (e.g., Plaster of Paris), and/or some other substance that changes the alkalinity of the slurry or causes the mixture to gel.

In some embodiments, a composition for use in producing an investment casting shell includes a slurry having a plurality of particles of varying size. Notably, some of the particles are larger than 100 mesh.

In some embodiments, the slurry includes colloidal silica, and the colloidal silica is 40% colloidal silica. Moreover, the slurry includes zircon flour in a range of about 200 mesh to 350 mesh.

In some embodiments, the slurry includes silicon carbide, primarily for heat retention, that is in a range of about 100 mesh to 300 mesh. The silicon carbide is preferably in a range of about 6% to 12% of the slurry by weight.

In some embodiments, a viscosity of the slurry is greater than about 2500 centipoise (cps). Preferably, the viscosity is greater than 100,000 cps.

In some embodiments, a composition for use in producing an investment casting shell, the composition comprising a slurry having a viscosity greater than 2500 cps.

In some embodiments, a composition for use in producing an investment casting shell includes a slurry that is usable for at least six hours without generally continuous agitation.

In some embodiments, a method of investment casting of a pattern includes applying a shell material slurry to the pattern, wherein the slurry includes particles of varying size, and wherein some of the particles being greater than about 100 mesh.

In some embodiments, the method further includes allowing the applied slurry to harden into a shell. Thereafter, the method includes filling the shell with a molten metal in less than about twenty-four (24) hours from completion of the applying step.

In some embodiments, the filling step is performed in less than about six hours from completion of the applying step.

In some embodiments, a method of casting includes applying a face coat to a pattern. Then the face coat is at least partially dried. The method next includes coating the pattern with a slurry composition to create a coated pattern. The method also includes allowing the coated pattern to harden into a shell, and filling the shell with a molten metal. Then, the molten metal is allowed time to solidify into an article, and the shell is removed from the article.

In some embodiments, the face coat includes colloidal silica, zircon flour, and fused silica.

DESCRIPTION OF THE PREFERRED EMBODIMENT

Figure 1A:
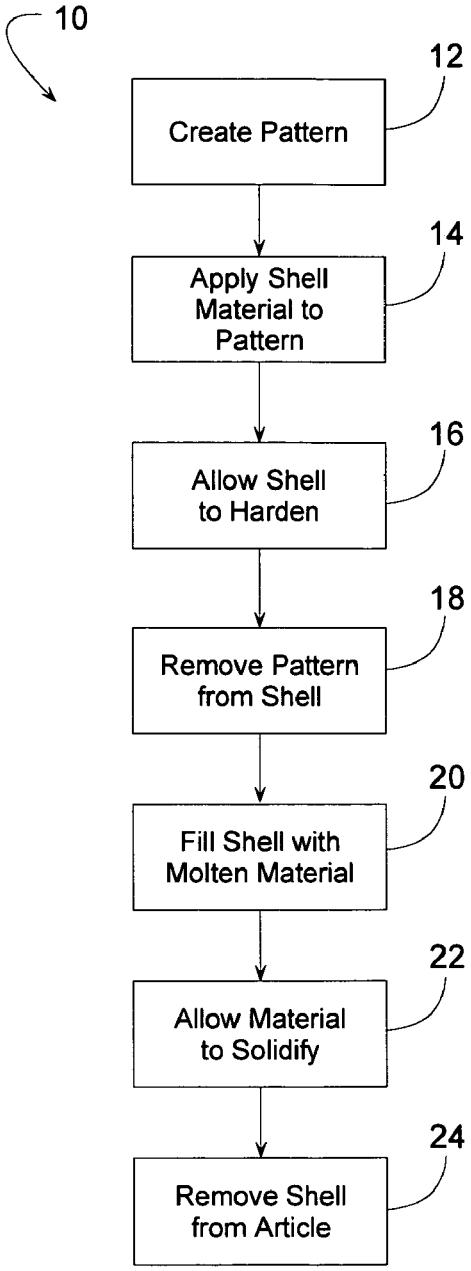
FIG. 1*a* is a flow diagram of one embodiment.
Figure 2A:
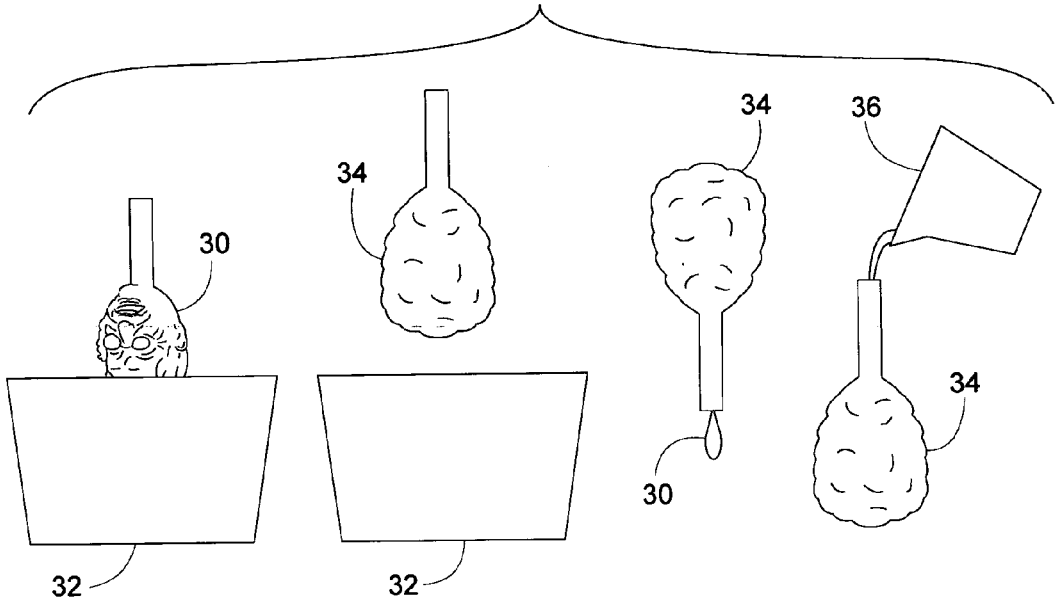
FIG. 2*a* is a schematic diagram of the embodiment associated with FIG. 1*a*.

Referring to FIGS. 1*a* and 2*a*, a method 10 of investment casting using an inventive casting shell that can be applied in as little as one coat, is shown and illustrated. Initially, a pattern 30 (FIG. 2*a*) is formed according to the user's specifications in Block 12. Note that the pattern 30 can be any type of part or article, and preferably is formed from a material readily removed under elevated temperatures. Although the pattern is preferably formed from wax, wax is not necessary. The pattern may be formed from any material that is adapted to being removed from the resultant shell material during the investment casting process, e.g., at elevated temperatures where the pattern melts or burns. For example, the pattern may be made of foam, paper products, etc.

In Block 14, a slurry shell material according to the preferred embodiment is applied to the pattern 30. As shown in FIG. 2*a*, pattern 30 may be dipped in a slurry 32 contained in a container. Alternately, the slurry may be brushed or hand packed on the pattern, for example. Contrary to conventional investment casting slurries, slurry 32 preferably has the consistency of conventional cake frosting. More particularly, whereas conventional slurries have a viscosity of about 2500 centipoise, the slurry of the preferred embodiments is much greater, and can be as much as 100,000 centipoise or more (i.e., unable to pass through a conventional zahn cup). Pattern or substrate 30 is coated with the slurry material in as little as one coat, without requiring any application of dry refractory powders to form a coated pattern 34. The coat is at least one-quarter of an inch thick and preferably about one-half of an inch thick. Coated pattern 34 is then allowed to cure or harden in Block 16. In some cases, this coated pattern is air-dried. Fans may be used as part of the air drying process. In addition, the coated pattern may be exposed to heat to facilitate the curing process. This is unique to the present shell material and investment casting process which allows the shell to be exposed to a range of temperatures, including highly elevated temperatures, specifically in a range from about room temperature to about 1850.degree. F., for extended periods of time without compromising the integrity of the resultant shell.

Once the mechanical water (which comprises a small portion of the shell, typically less than 1% using the shell material of some embodiments) is removed by this drying process, the pattern may be removed from the shell in Block 18. In some cases, the investment mold is exposed to heat (anywhere between about room temperature to 1850.degree. F.) in order to evacuate the pattern, as shown in the third illustration from the left in FIG. 2*a*. After the pattern has been eliminated, the resultant mold is prepared for molten metal casting in conventional fashion. Note that the pattern may be removed from the shell upon pouring the molten metal of the next step of the investment casting process, if the pattern is made from an appropriate combustible material such as foam. Notably, in this regard, because the metals are poured at such high temperatures, for example, bronze is poured at 2200.degree. Fahrenheit, iron is poured at 2550.degree. Fahrenheit, the typical 1850.degree. Fahrenheit "burn out" to remove the pattern and cure the shell may not be required.

In Block 20, the hollow shell is filled with molten metal 38 and is allowed to cool and solidify in Block 22. Thereafter, the colloidal refractory shell is removed. This step, in Block 24, may be accomplished by hammering, sandblasting, bead blasting, or any other suitable method that preserves the resultant casting. In this regard, for example, metal casting may be shot blasted, while an acrylic medium typically would require an appropriate chemical solution, such as sodium hydroxide, to remove the refractory shell.

Overall, the method and corresponding shell composition allow the user to create castings of patterns with minute detail. Moreover, it allows the user to physically generate quality castings in less than a twenty-four hour "pattern-to-pour" cycle time (defined as the time elapsed from application of the shell material to the pattern (Block 14) to filling the hardened shell with molten metal (Block 20)), and in some cases less than a six hour pattern-to-pour cycle time. This is opposed to traditional investment casting methods that typically require a minimum of twenty-four hours of preparation time prior to being able to pour the molten metal.

In addition, as described further below, the resultant shells of some embodiments retain more heat than traditional shells, thus allowing the metal to be poured at lesser temperatures, thus yielding higher quality (greater detail, etc.) castings, as described previously. Moreover, the "shelf life" of the slurry is significantly longer than traditional investment casting slurries given that the slurry can sit in a container and not settle out or harden, in direct contrast to known slurries that must be continuously blunged to maintain their integrity as a slurry.

Another benefit of some embodiment is that the byproducts associated with the shell can be hammer milled or sieved, for instance, to the proper mesh size and reused at nearly one hundred percent in future production runs. As a result, the shell material is environmentally friendly, unlike traditional investment casting shell materials that typically become landfill material. One key to realizing these investment casting improvements is the composition of the refractory shell material, which will be described in detail immediately below.

To achieve the above-noted benefits, the composition of the investment casting shell material may be as follows. Initially, a known refractory composition having the following components including $Al_2O_3$ at about 73.5% (in the range of about 71.5-75%), SiC at about 17.5% (in the range of 16.5-19.5%), $SiO_2$ at about 6.5% (in a range of about 4.5%-8.7%), CaO at about 0.1% (in a range of about 0.0%-0.5%), $Fe_2O_3$ at 0.3% (in a range of about 0.2%-0.5%), and $TiO_2$ at 2% (in a range of about 1.5%-2.5%), which will be referred to herein as "HP4" or the "known refractory") can be used to provide a shell material that achieves at least some of the benefits discussed above. However, this simple composition, when used in a slurry for the shell material, has drawbacks that will become clear with the below discussion. Therefore, alternate compositions described herein were derived with the corresponding benefits discussed below.

First, beginning with an amount of the known refractory, one alternate composition includes removing all large chunks of material from the known refractory so that the remaining material has a consistency similar to baking flour. In this regard, sieving the known refractory with a "4 mesh" sieve was found to be ideal in the following recipe. The term "mesh" is used hereinafter and refers to the number of openings per inch of a sieve, thus providing a measure of the size of the corresponding particles being described. For example, the term "4 mesh" is a particle size measurement that may be referred to as its Tyler equivalent. In this case, 4 mesh refers to an opening size of 4.76 mm, or 0.187 inch.

A shell material recipe for the slurry of some embodiments combines the modified known refractory with other ingredients as follows: about 40-42% (preferably about 41%) modified known refractory (4 mesh); about 0.0-0.1% (preferably about 0.05%) Plaster of Paris; about 19-21% (preferably about 20.0%) fused silica, about 2-3% (preferably about 2.5%) perlite, and about 34.5-37.5% (preferably about 36.0%) colloidal silica (40% solution). This mixture, when incorporated in the present investment casting process, allows the user to, among other methods, either dip or brush the wax pattern such that the resultant shell hardens in a short amount of time, e.g., within about seven minutes.

The colloidal silica, which is preferably a colloid of amorphous silica particles in a suspension of ionized water, is provided as a liquid binder providing a vehicle for the other dry materials to mix into. The colloidal silica acts as a fluxing agent at high temperatures. Notably, colloidal silica has a pH of about 9+. In the event that the pH is changed too much by using reactive material in the mixture, the mixture will set up too fast and will be non-usable. Generally, the colloidal silica used in this invention is preferably 40% $SiO_2$ by weight and 0.5% $Na_2O$ by weight, in a water base. However, either 30% or 40% colloidal silica, for example, may be used with generally equal results.

The fused silica is employed to provide a refractory material that is a non-reactive filler. Specifically, in this regard, the fused silica will not react with, and thus will not alter, the pH of the colloidal silica. Fused silica therefore provides a good filler. Moreover, the fused silica also has good thermal shock resistance. The fused silica used in the preferred embodiments is preferably in a range of 90-150 mesh, and more preferably 120 mesh.

Note that the Plaster of Paris used is a hemi-hydrated calcium sulfate ($CaSO_4$ and $\frac{1}{2}H_2O$) that is employed to improve the brushability of the slurry. Plaster of Paris typically includes SiO at 0.94%, $Fe_2O_3$ at 0.28%, $Al_2O_3$ at 0.69%, $CaSO_4$, $\frac{1}{2}H_2$ at 97.97%, and MgO at 0.17%.

Finally, perlite is employed as a feldspathic filler. In particular, perlite is a reactive material and can change the pH of the colloidal silica as so desired. For example, perlite can be used to cause acceleration of the setting of the shell material. As an alternative, substitutes such as Herculon fiber, comprising very fine particles, may be used to achieve similar effects. Herculon is a registered trademark of Hercules Inc. of Wilmington, Del. The perlite that is used in some embodiments is either a fine 60 grit or a medium 30 grit mesh. Perlite is a naturally occurring silicous volcanic rock which is approximately 75% $SiO_2$ and 15% $Al_2O_3$. Perlite is used in some embodiments as a filler due to its larger particle size relative to the other fillers.

The amount of plaster (Plaster of Paris) or feldspathic filler that is included within the slurry may be adjusted to modify the setting time. Too much plaster may cause the shell to cure within three to four minutes, which does not provide sufficient working time for the applications contemplated by the preferred embodiments, with even approximately seven minutes being too short for some applications. In addition, as an alternative to the plaster, perlite, and even the HP4 for altering the allowed working time of the slurry, pure chemicals such as MgO and CaO may be used.

In some embodiments that do not employ the known refractory, the shell material slurry includes a combination of colloidal silica, zircon powder, and fused silica with a variety of other materials. These materials include at least some of the following: colloidal silica, latex colloidal silica, zircon powder, fused silica, alumina, welan gum, perlite, Mulcoa 60 (Mulcoa is a registered trademark of C-E Minerals of King of Prussia, Pa.), frit 3124 (frit 3124 is a product of Ferro Corporation of Cleveland, Ohio), corn starch, Kelco-crete (Kelco-crete is a registered trademark of CP Kelco of Atlanta, Ga.) and silicon carbide. Each of these components and their corresponding functions will be described in detail below, with some embodiments of the slurry illustrated in Table 1.

Zircon flour is a refractory component. The zircon flour used in this invention ($ZrSiO_4$) is a fine powder, preferably in a range of 200-350 mesh, and more preferably 325 mesh. Zircon flour is used in the present invention to reduce the amount of oxidation that occurs during the molten metal pouring process. Zircon flour has a high density which facilitates allowing the shell material to settle into the finer details of a pattern. Additionally, the fine particle size of zircon flour aids in keeping the slurry of the preferred embodiment in suspension, i.e., sagging, which can compromise the quality of the cast as understood in the art, is minimized. Moreover, in this regard, the fine particles also prevent settling of the slurry when not in use. Therefore, slurry shelf life is greatly improved without continuous blunging, which, as previously discussed, is a desired feature.

Alumina, such as tabular alumina, is a non-reactive refractory material that provides larger particle sizes for the shell mixture. It typically has low porosity and a high density and provides an inexpensive additive. Tabular aluminas are preferably 50-325 mesh and are produced by sintering ball-formed calcined alumina, then crushing the tabular alumina balls.

The latex colloidal silica used in some embodiments is preferably 30% $SiO_2$ by weight in water with a latex solution.

By adjusting the percentages of the various components noted above, the properties of some embodiments discussed previously have been achieved. Examples of some components for the slurry and corresponding workable ranges, will hereinafter be discussed.

Table 1 illustrates, by way of example, nine different sample compositions of the present invention. Component quantities are given by way of weight percentages.

TABLE 1

| | Composition by weight (wt. %) | | | | | | | | | | |
|---|---|---|---|---|---|---|---|---|---|---|---|
| | Colloidal Silica | Latex Colloidal Silica (30%) | Zircon Flour 325 mesh | Fused Silica 120 mesh | Malcoa 60 200 mesh | Alumina 325 mesh | Alumina 50-200 mesh | Silcon Carbide 200 mesh | Frit 3124 | Kelco-crete | Corn Starch |
| e.g. 1 | 24.2 | 0 | 15.2 | 12.9 | 10.7 | 10.7 | 10.7 | 6.8 | 6.8 | .75 | .75 |
| e.g. 2 | 6.7 | 22.8 | 33.6 | 20.1 | 16.8 | 0 | 0 | 0 | 0 | 0 | 0 |
| e.g. 3 | 5.7 | 19.5 | 28.7 | 17.2 | 0 | 14.4 | 14.4 | 0 | 0 | 0 | 0 |
| e.g. 4 | 7.1 | 24.1 | 35.5 | 21.3 | 0 | 0 | 0 | 12.1 | 0 | 0 | 0 |
| e.g. 5 | 4.6 | 15.7 | 23.1 | 13.9 | 11.6 | 0 | 23.1 | 7.9 | 0 | 0 | 0 |
| e.g. 6 | 24.2 | 0 | 33.3 | 19.7 | 10.6 | 0 | 0 | 0 | 4.5 | 0.7 | 0.7 |
| e.g. 7 | 24.2 | 0 | 26.5 | 16.7 | 0 | 13.6 | 0 | 0 | 3.8 | 0.8 | 0.8 |
| e.g. 8 | 24.2 | 0 | 35.6 | 21.2 | 0 | 0 | 0 | 12.1 | 5.3 | 0.8 | 0.8 |
| e.g. 9 | 24.2 | 0 | 20.4 | 12.9 | 10.6 | 0 | 20.4 | 6.8 | 3.0 | 0.8 | 0.8 |

Next, Mulcoa 60 is a commercially manufactured fused material. It is a fritted material, which introduces a variety of materials, including alumina and silica, into the mix. Mulcoa 60 is a refractory calcine and is non-reactive. Moreover, it is a high mullite chamotte produced by calcining low alkali clays. The composition of Mulcoa 60 is approximately 60% $Al_2O_3$ and 36% $SiO_2$. Mulcoa 60 is a fused material that is relatively fine and thus facilitates suspension. Other fritted materials, e.g., "frit 3134" are employed in some of the examples of Table 1. Generally, these materials, when hardened into the shell, individually and collectively provide a fused matrix that allows the shell material to be readily cracked upon completion of the casting process.

Silicon carbide (SiC) is a crystalline compound of silicon and carbon, and is provided for its high temperature strength properties, with low thermal expansion and for its ability to allow the shell to retain heat for longer periods of time. These features allow the molten metal to be poured at a lower temperature. Again, when the molten metal is poured at a lower temperature, metal oxidation is reduced and greater part detail can be provided. Also, safety is improved, and energy use is decreased. It is preferably about 100-300 mesh, and more preferably, about 200 mesh.

Corn starch is provided to promote thickness of the mixture and to provide greater adherence of the mixture to the pattern, working almost as a glue. Welan gum, such as Kelco-crete, may be used in addition, or as an alternative, to corn starch. Another alternative that could be used in this regard is carboxy methyl cellulose (CMC) because materials such as corn starch are perishable. Therefore, Kelco-crete is preferred.

Finally, the latex colloidal silica is similar to the colloidal silica but includes 3% latex which primarily acts to prevent cracking during shell curing, and render the slurry more elastic and thus more brushable. Alternatively, styrenes may be used as a substitute to provide a more paint-like product.

In the Table 1 examples, the component ranges are: colloidal silica at about 0.0%-24.2%, latex colloidal silica at about 0.0%-24.4% (with the overall colloidal silica component preferably being at least 20% by volume), zircon flour at about 15.2%-35.6%, fused silica at about 12.9%-21.2%, Mulcoa 60 at about 0.0%-16.8%, tabular alumina (325 mesh), at about 0.0%-14.4%, tabular alumina (50-200 mesh) at about 0.0%-23.1%, silicon carbide at about 0.0%-12.1%. Also, although preferred mesh sizes are noted, preferred usable ranges include: zircon flour (200-350 mesh), fused $SiO_2$ (90-150 mesh), Mulcoa 60 (180-240 mesh), SiC (100-300 mesh).

With respect to the different examples, the first example (Ex. 1) is directed to a back coat that is an alternate of the slurry recipes including the known refractory discussed initially, with none of the known refractory material included. (Note that one element is missing in Ex. 1 of Table 1, Mulgrain is preferably included at about 3%.) Mulgrain is a registered trademark of C-E Minerals of King of Prussia, Pa. Examples two through five (Exs. 2-5) are directed to alternate preferred recipes, where Ex. 4 is preferred if heat retention (e.g., pouring at lower temperatures) is a primary concern, while Ex. 5 provides a high quality shell with the benefits of the preferred embodiments discussed herein, at the cost of additional materials which further diversify particle size and thus aid suspension. Examples six through nine (Exs. 6-9) correspond generally to examples 2-5, respectively, but are modified slightly, generally for increased adhesive properties useful, for instance, when the application step is performed by, for instance, hand packing.

Figure 3A:
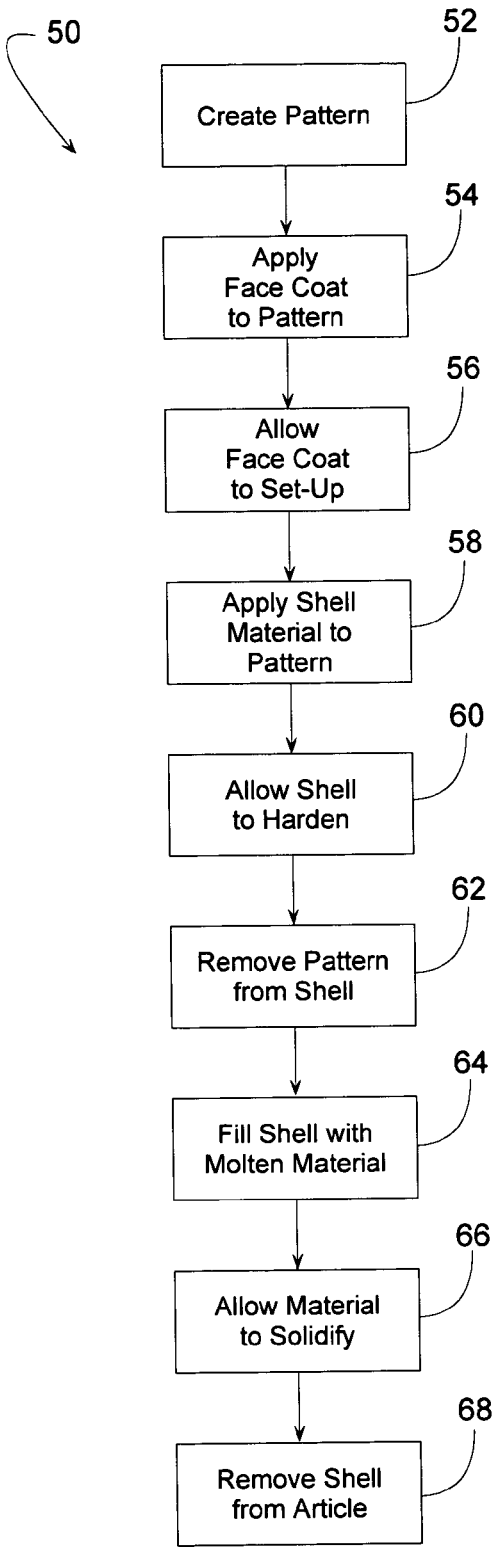
FIG. 3*a* is a flow diagram of another embodiment.

Referring next to FIG. 3*a*, an optional face coat may be applied with an alternate preferred embodiment. A method 50 according to this alternative includes initially creating a pattern of the part to be cast at Block 52. Then, contrary to the previous embodiment, a face coat is applied to the pattern as a first coat in Block 54. Again, the coat may be applied using any of a variety of methods including spraying, hand packing, brushing, etc. Then, in Block 56, the face coat is allowed to set up. Preferably, this is a relatively thin coat. Next, in Block 58, the inventive shell material is applied to the pattern. Thereafter, the shell is allowed to harden in Block 60. Subsequent coats may be used, but are not preferred. Thereafter, in Block 62, the pattern is removed from the colloidal refractory shell as described previously.

In Block 64, the shell is filled with a molten material to form the part that is being cast. Once the material solidifies in Block 66, the shell is removed from the cast part in Block 68 according to the methods described previously.

A face coat (Block 54) may be used in situations where, for example, there is a concern that the molten material would otherwise react with materials in the casting shell. When a face coat is used, it is applied directly to the pattern and allowed to set-up for a short time prior to applying the backup shell material to the face-coated pattern. One such face coat composition uses colloidal silica, zircon, fused silica, and welan gum. More particularly, the preferred face coat composition includes about each of the following: about 4-8% colloidal silica, about 14-21% latex colloidal silica (and at most about 24% colloidal silica total), about 31-33% zircon flour (about 325 mesh), about 16-18% fused $SiO_2$ (about 120 mesh), about 6% frit 3124, about 0.0% to 1% Kelco-crete.®., and about 0.0% to 1% corn starch, in a water base (about 20%).

Figure 4:
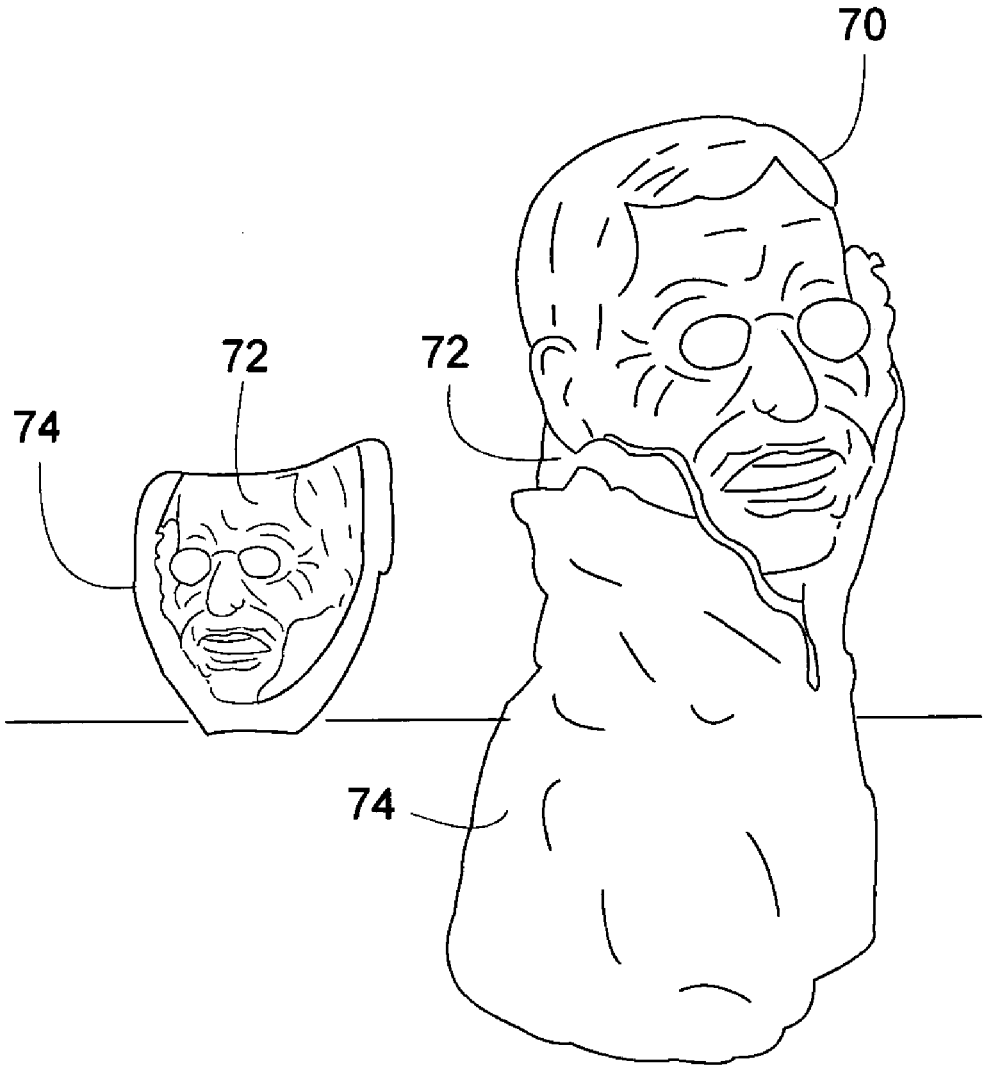
FIG. 4 is a front view of a casting and its shell that were made using the composition and method of some embodiments.

A resultant cast part is shown in FIG. 4, where a metal 70 has hardened to a sculpture. In this case, a face coat 72 and a back coat 74 were applied as part of the two-step process 50 described above. The benefits of some embodiments were realized in completing this cast, including fine part detail and unprecedentedly short pattern-to-pour cycle time.

Reviewing the benefits of some embodiments, it is notable that the slurry compositions harden quickly relative to conventional materials and methods. And, the composition and method of some embodiments allow an investment shell to be created, in some cases, in as little as three hours.

Conventional compositions and methods for creating investment casting shells require that slurries be continually mixed in order to prevent heavier components from settling out of the slurry. The present composition and method achieves a slurry with a consistency similar to cake frosting which remains stable, without mixing, for long periods of time.

Due to the consistency of the slurry, it is possible to apply the slurry to a pattern using many methods including brushing, spraying, dipping, or packing. When hand packing is the desired method of application, some embodiments utilize corn starch to thicken the slurry and prevent sagging of the material when it is applied to a pattern. Again, alternatively, welan gum may be used in place of corn starch to achieve a similar effect. Notably, due to the issue of microbial contamination, the use of welan gum allows the slurry to have a longer shelf life than if corn starch is used. If cornstarch is used, it may be desirable to add an anti-microbial agent into the slurry to retard the growth of bacteria.

In some embodiments, silicon carbide is used to provide the casting shell with improved heat retaining ability. This improved heat retaining ability allows the casting material to be poured at a lower temperature. Pouring a material at a lower temperature drastically reduces the amount of energy required to melt and sustain the casting material's pour temperature. Thus, energy expenses are reduced. Moreover, a lower pour temperature typically yields fewer occurrences of and less severe surface oxidation. Again, when surface oxidation is minimized, post-casting cleanup operations are significantly reduced or eliminated.

Figure 1B:
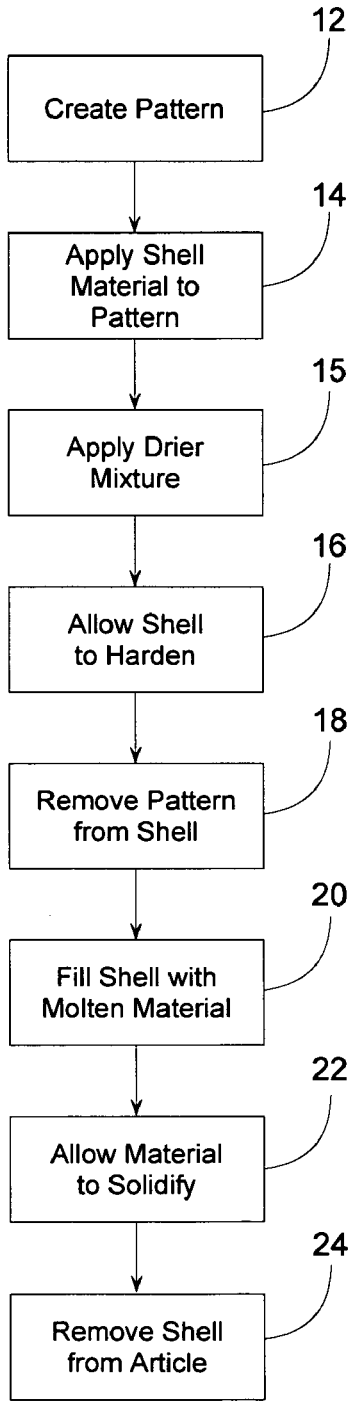
FIG. 1*b* is a flow diagram similar to FIG. 1*a* but showing another embodiment.
Figure 2B:
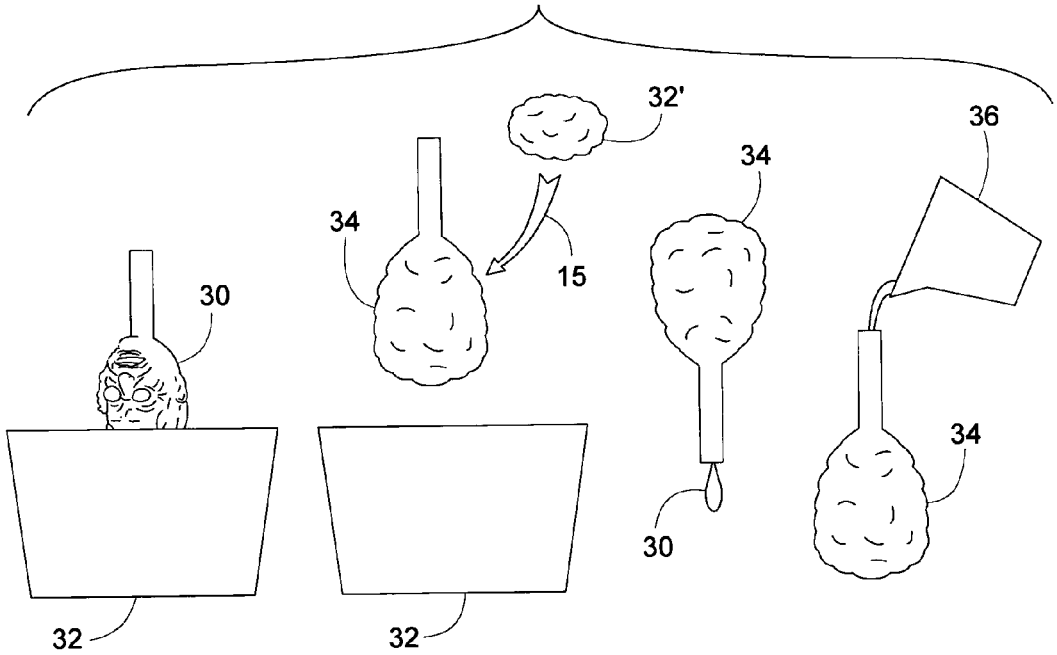
FIG. 2*b* is a schematic diagram similar to FIG. 2*a* but showing the embodiment associated with FIG. 1*b*.
Figure 3B:
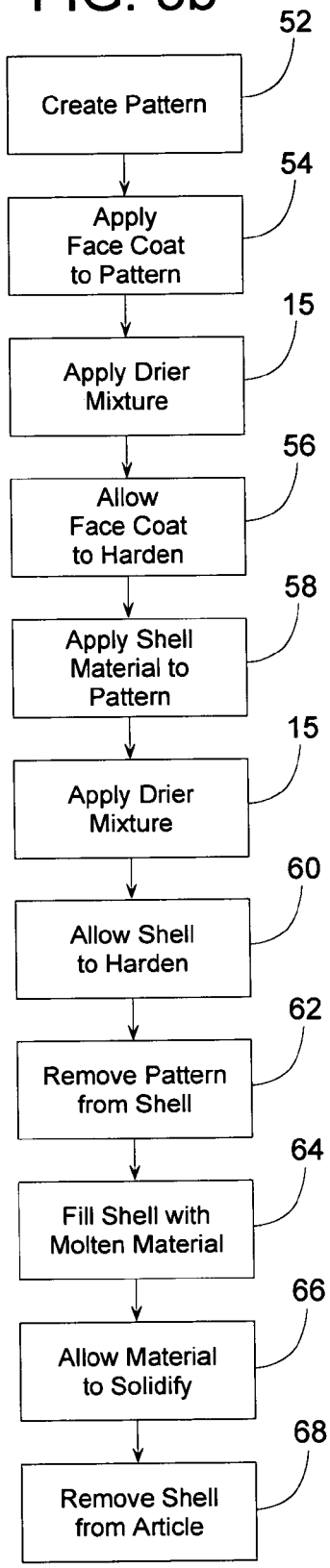
FIG. 3*b* is a flow diagram similar to FIG. 3*a* but showing another embodiment.

Referring to FIGS. 1*b*, 2*b* and 3*b*, in some embodiments, a slurry of shell material 32 applied to pattern 30 can be hardened more quickly by subsequently coating the moist layer of slurry 32 with a stucco coat 32' or drier mixture of the slurry's components. In some cases, stucco coat 32' may include some magnesium-containing compound (such as MgO), calcium-containing compound, and/or some other substance that changes (increases or decreases) the alkalinity of the slurry, whereby the alkaline-modifying substance tends to react with the colloidal silica based slurry 32 to hasten the slurry's hardening. Best results may be achieved when the weight of the magnesium-containing compound, calcium-containing compound, or alkaline-modifying substance comprises no more than 20% of stucco coat 32' (and preferably no more than 15%). The step of applying stucco coat 32' is identified by numeral 15 of FIGS. 1*b*, 2*b* and 3*b*.

The method of promoting the hardening of a layer of slurry with an overcoat of a relatively dry version of the slurry can be applied to any of the slurry recipes mentioned earlier herein. Examples of stucco coat 32' include, but are not limited to, a mixture comprising one or more of the following: HP4 (Magneco Matrel, Addison, Ill.), relatively dry Plaster of Paris, 120 fused silica, perlite, and relatively dry silica (e.g., $SiO_2$). Other examples of stucco coat 32' include, but are not limited to, the dry components of the mixtures listed in Table 1. Since the various recipes of Table 1 are moist by virtue of the colloidal silica, the dry components are, of course, everything except the colloidal silica.

In some embodiments, stucco coat 32' may include an amorphous mineral silicate such as SUPER SORBENT, which is a product of WYK Sorbents of St. Louis, Mo. Amorphous mineral silicate is the currently preferred example of a moisture-absorbing mineral silicate; however, other types of moisture-absorbing mineral silicate are well within the scope of the invention. In some cases, the amorphous mineral silicate comprises a mixture of $SiO_2$ (approximately 66-72%), CaO (approximately 1-4%), $Al_2O_3$ (approximately 11-17%), and $K_2O$ (approximately 1.5-4.7%). The amorphous mineral silicate may further comprise $Fe_2O_3$ (approximately 2-4%) and $Na_2O$ (approximately 3-5%). Although stucco coat 32' may be comprised entirely of the amorphous mineral silicate, stucco coat 32' is preferably a mixture (e.g., 50/50 by weight) of the amorphous mineral silicate and the drier components of shell material 32.

With an overcoat of stucco coat 32', the underlying slurry shell material 32 may dry within minutes, rather than hours. In some cases, two or more applications of slurry 32 and stucco coat 32' may be applied for larger castings. Relatively thin coats are suitable for small shells, but thicker coats may be needed for larger shells.

In FIG. 3*b*, step 54 illustrates the use of a face coat (as explained in U.S. patent application Ser. No. 10/697,378), a first step 15 illustrates the application of a first coating of stucco coat 32' to hasten the hardening of the face coat, step 58 illustrates the application of slurry shell 32 whose composition may differ from that of the face coat (explained earlier herein), a second step 15 illustrates the application of a second coating of stucco coat 32' to hasten the hardening of slurry 32.

The method illustrated in FIGS. 1*b*, 2*b*, and 3*b* can be used not only for investment casting recipes and slurries mentioned earlier herein, but can also be used with traditional recipes already being used in today's ceramic shell investment industry.

It should be noted that all compositions or mixtures mentioned herein and specified as a percentage or ratio are with reference to the weight of the various components. U.S. patent application Ser. No. 10/697,378 as originally filed is specifically incorporated by reference herein.

Although the invention is described with reference to a preferred embodiment, it should be appreciated by those of ordinary skill in the art that various modifications are well within the scope of the invention. Therefore, the scope of the invention is to be determined by reference to the following claims:

The invention claimed is:

1. An investment casting method for creating an article from a pattern, the method comprising:

covering at least a portion of the pattern with a slurry, wherein the slurry comprises a colloidal silica and a first quantity of a plurality of drier components, whereby the slurry is a moist mixture by virtue of the colloidal silica;

applying a stucco coat over the slurry to hasten the hardening of the slurry into a shell, wherein the stucco coat comprises a moisture-absorbing amorphous mineral silicate, and the stucco coat is drier than the slurry as the stucco coat is being applied to the slurry;

replacing the pattern with a molten material; and allowing the molten material to solidify in the shell to produce the article.

2. The investment casting method of claim 1, wherein the stucco coat comprises the moisture-absorbing amorphous mineral silicate plus a second quantity of the plurality of drier components.

3. The investment casting method of claim 1, wherein the stucco coat includes a silicon dioxide, a calcium oxide, an aluminum oxide, and a potassium oxide.

4. The investment casting method of claim 3, wherein the stucco coat also includes an iron oxide.

5. The investment casting method of claim 3, wherein the stucco coat also includes a sodium oxide.

6. The investment casting method of claim 1, further comprising prior to covering at least a portion of the pattern with the slurry:

applying a face coat to the pattern; and applying the stucco coat over the face coat to hasten the hardening of the face coat, whereby the stucco coat hastens the hardening of both the face coat and the slurry.

7. The investment casting method of claim 6, wherein the face coat and the stucco coat are comprised of different compositions.

8. An investment casting method for creating an article from a pattern, the method comprising:

applying a slurry to the pattern, wherein the slurry comprises a colloidal silica and a first quantity of a plurality of drier components, whereby the slurry is a moist mixture by virtue of the colloidal silica;

after applying the slurry to the pattern, modifying the alkalinity of the slurry;

applying a stucco coat over the slurry to hasten the hardening of the slurry into a shell, wherein the stucco coat comprises a moisture-absorbing amorphous mineral silicate plus a second quantity of the plurality of drier components, and the stucco coat is drier than the slurry as the stucco coat is being applied to the slurry;

replacing the pattern with a molten material; and allowing the molten material to solidify in the shell to produce the article.

9. The investment casting method of claim 8, wherein the stucco coat includes a silicon dioxide, a calcium oxide, an aluminum oxide, and a potassium oxide.

10. The investment casting method of claim 8, wherein the stucco coat includes an iron oxide.

11. The investment casting method of claim 8, wherein the stucco coat includes a sodium-containing compound.

12. The investment casting method of claim 8, wherein the alkalinity of the slurry increases upon modifying the alkalinity of the slurry.

13. The investment casting method of claim 8, further wherein the alkalinity of the slurry decreases upon modifying the alkalinity of the slurry.

14. The investment casting method of claim 8, wherein modifying the alkalinity of the slurry involves applying a magnesium-containing compound to the slurry.

15. The investment casting method of claim 8, wherein modifying the alkalinity of the slurry involves applying a calcium-containing compound to the slurry.

* * * * *